US008568181B2

(12) United States Patent
Below

(10) Patent No.: US 8,568,181 B2
(45) Date of Patent: Oct. 29, 2013

(54) SPARK PLUG WITH UNDERCUT INSULATOR

(75) Inventor: Matthew Brian Below, Fundlay, OH (US)

(73) Assignee: Fram Group IP LLC, Lake Forest, IL (US)

( * ) Notice: Subject to any disclaimer, the term of this patent is extended or adjusted under 35 U.S.C. 154(b) by 0 days.

(21) Appl. No.: 13/283,715

(22) Filed: Oct. 28, 2011

(65) Prior Publication Data

US 2012/0104927 A1 May 3, 2012

Related U.S. Application Data

(60) Provisional application No. 61/407,716, filed on Oct. 28, 2010.

(51) Int. Cl.
*H01T 21/02* (2006.01)

(52) U.S. Cl.
USPC ..... 445/7; 313/144

(58) Field of Classification Search
USPC ..... 313/118–145; 123/32, 41, 143 R, 123/146.5 R, 169 P, 260, 280, 169 R, 169 EL, 123/310; 219/121.6, 121.64; 445/7
See application file for complete search history.

(56) References Cited

U.S. PATENT DOCUMENTS

| | | | | |
|---|---|---|---|---|
| 3,569,765 | A | 3/1971 | Moray | |
| 5,091,672 | A | 2/1992 | Below | |
| 5,697,334 | A | 12/1997 | Below | |
| 5,918,571 | A | 7/1999 | Below | |
| 6,104,130 | A | 8/2000 | Below | |
| 7,449,824 | B2 * | 11/2008 | Moribe et al. | 313/144 |
| 8,030,831 | B1 | 10/2011 | Below | |
| 2003/0168955 | A1 * | 9/2003 | Suzuki | 313/143 |
| 2008/0238284 | A1 * | 10/2008 | Moribe et al. | 313/144 |
| 2008/0272683 | A1 | 11/2008 | Boehler | |
| 2009/0079319 | A1 * | 3/2009 | Boehler et al. | 313/141 |
| 2009/0121603 | A1 * | 5/2009 | Below et al. | 313/143 |
| 2009/0189503 | A1 * | 7/2009 | Below | 313/141 |
| 2009/0189505 | A1 | 7/2009 | Below | |
| 2009/0189506 | A1 | 7/2009 | Below | |
| 2010/0201245 | A1 * | 8/2010 | Miller et al. | 313/143 |
| 2012/0104927 | A1 | 5/2012 | Below | |

* cited by examiner

*Primary Examiner* — Donald Raleigh
(74) *Attorney, Agent, or Firm* — Erin J. Fox; Barnes & Thornburg LLP

(57) ABSTRACT

A spark plug for an internal combustion engine, the spark plug having: an elongated center electrode having a center electrode tip at one end and a terminal proximate the other end; an insulator substantially surrounding the center electrode, the insulator having a channel formed in an exterior surface of the insulator; and an outer shell surrounding the insulator, the outer shell having a jamb nut portion and a distal end extending from the jamb nut portion, the distal end of the outer shell is aligned with the channel such that the distal end of the outer shell is received in and engages the channel of the outer shell.

8 Claims, 2 Drawing Sheets

SPARK PLUG WITH UNDERCUT INSULATOR

CROSS REFERENCE TO RELATED APPLICATIONS

This application claims the benefit of U.S. Provisional Patent Application Ser. No. 61/407,716 filed Oct. 28, 2010, the contents of which are incorporated herein by reference thereto.

BACKGROUND

This application relates generally to spark plugs for internal combustion engines and, more particularly, to a jamb nut to insulator interface that to reduce loads on the spark plug insulator.

Traditional spark plug construction includes an annular metal casing having threads near one end and a ceramic insulator extending from the threaded end through the metal casing and beyond the opposite end. A central electrode is exposed near the threaded end and is electrically connected through the insulator interior to a terminal which extends from the opposite insulator end to which a spark plug ignition wire attaches.

The force applied to seal the spark plug in the head is the result of torque transmitted by the threaded metal casing; hence, the threaded portion of the metal casing must be sturdy and of substantial size. A portion of the metal casing is formed to be engaged by a socket tool to provide torque to the threaded portion. The threaded portion is located away from the portion which is engaged by the socket tool.

To facilitate the controlled and efficient exhaust of gases from a combustion chamber, the valves are sometimes increased in size. This may necessitate a decrease in the size of the spark plug, a reduction in the size and sturdiness of the threaded metal casing end, and, in particular, a decrease in the inside diameter of the metal bore of the spark plug and in the combustion chamber wall area available to threadedly receive the spark plug.

The maximum diameter of the ceramic insulator is in turn determined by the size of the hex or jamb nut portion of the outer shell. Accordingly and for smaller hexes the barrel diameter of the ceramic insulator is reduced. The diameter ceramic insulator is also dictated by the clearance needed for shell hex and crimp along with the shoulder needed to keep the ceramic in place during a lifetime of operation.

In the past and for 14 mm and 16 mm spark plug hexes (12 mm spark plugs), the diameter of the ceramic insulator is different for each application and requires different ignition boots. For example, the 14 mm hex uses a 9.0 mm diameter ceramic barrel and the 16 mm hex uses a 10.5 mm diameter ceramic barrel.

Accordingly, it would be desirable to provide a 14 mm hex spark plug that can use the larger diameter insulator of the 16 mm hex spark plug.

The decrease in the diameter of the spark plug may also reduce the spark plugs ability to hold onto its ground shield during removal. A higher strength steel jamb nut has been proposed to combat this problem however, a higher strength steel jamb nut is assembled to the insulator with higher loads than a lower strength steel jamb nut thus, the impact strength of the insulator may be negatively affected.

Accordingly, the inventor herein has recognized that it is desirable to provide a jamb nut to insulator interface that reduces loads upon the insulator. In addition, the inventor has recognized that it is also desirable to use smaller spark plug hex designs with ceramic insulator barrels and ignition wires typically associated with larger spark plug hex designs.

SUMMARY

Exemplary embodiments of the present invention relate to a spark plug for an internal combustion engine. The spark plug having an elongated center electrode having a center electrode tip at one end and a terminal proximate the other end; an insulator substantially surrounding the center electrode, the insulator having a channel formed in an exterior surface of the insulator; and an outer shell surrounding the insulator, the outer shell having a jamb nut portion and a distal end extending from the jamb nut portion, the distal end of the outer shell is aligned with the channel such that the distal end of the outer shell is received in and engages the channel of the outer shell.

Exemplary embodiments of the present invention also relate to a method of forming a spark plug. The method including the steps of: inserting an insulator into an outer shell of a spark plug, the insulator having a first portion, a second portion and a third portion, the first portion being located at one end of the insulator and the third portion being located at an opposite end of the insulator, wherein a channel is located between the second portion and the third portion and the second portion has a larger thickness than the first portion and the third portion, the insulator further comprising a shoulder portion located between the channel and the second portion; contacting the shoulder portion with a distal end of the outer shell, the distal end extending from a jamb nut portion of the outer shell; and securing a ground shield between another shoulder portion of the insulator and an opposite distal end of the outer shell, the another shoulder portion being located between the first portion and the second portion of the insulator.

DESCRIPTION OF EXEMPLARY EMBODIMENTS

Figures 1, 2, 3:
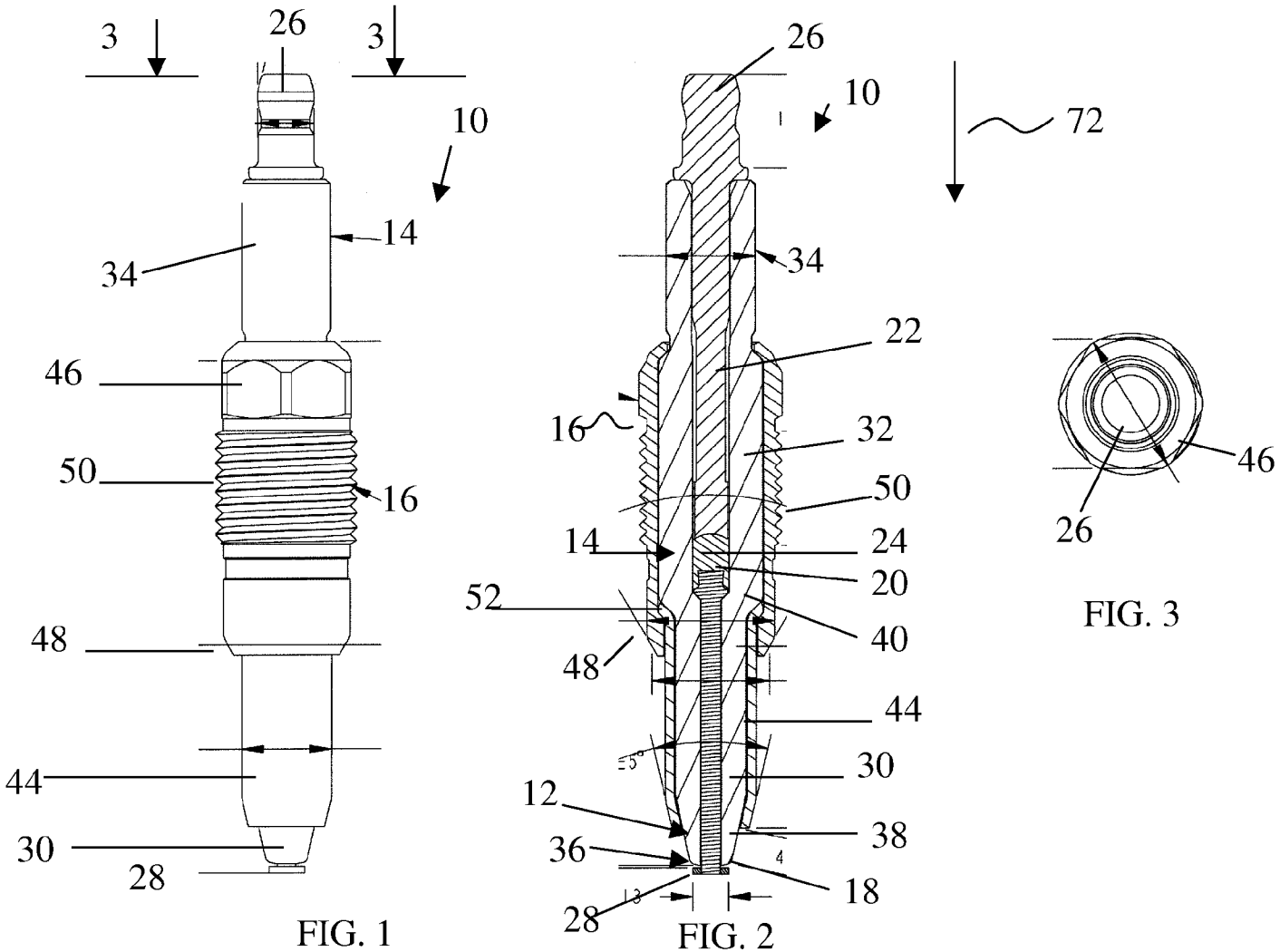
FIG. 1 is a side view of a spark plug in accordance with an exemplary embodiment of the present invention.
FIG. 2 is a cross-sectional side view of the exemplary spark plug illustrated in FIG. 1.
FIG. 3 is a view along lines 3-3 of FIG. 1.

FIGS. 1-4 illustrate an overall structure of an exemplary embodiment of the present invention. A spark plug 10 is illustrated and designed for use in internal combustion engines. The installation of spark plug 10 into an internal combustion engine is achieved by fitting it so that it protrudes into a combustion chamber (not shown) of the engine through a threaded bore provided in the engine head (not shown). Spark plug 10 includes a cylindrical center electrode 12 extending along the axial length of the spark plug, a ceramic or similarly comprised insulator 14 that concentrically surrounds center electrode 12, and an outer shell 16 that concentrically surrounds insulator 14.

In the illustrated embodiment, center electrode 12 has a cylindrical body with a tip 18 at one end and an end 20 of center electrode 12 opposing tip 18 is electrically connected to a cylindrical terminal stud 22 through an electrically conductive glass seal 24. In one embodiment, the electrically conductive glass seal can be a fired-in seal. The glass seal serves as the electrical connection between terminal stud and the center electrode. The terminal stud further comprises a terminal nut 26 that protrudes from the insulator and is configured to attach to an ignition cable (not shown) that supplies the electric current to the plug when the plug is installed. In an alternative embodiment, a resistive element may be disposed between the terminal stud and the center electrode.

The center electrode may comprise a core made of a highly heat conductive metal material such as, for example, copper, covered by a longer than conventional sheath made a highly heat-resistant, corrosion-resistant metal material such as, for example, Inconel, another nickel-based alloy, or other suitable metal or metal alloy. Still further, the center electrode will have a noble metal chip 28, such as one made from a gold, palladium, or platinum alloy in any suitable form for enabling proper spark plug functioning such as, for example, flat or finewire, that is joined to center electrode tip 18 to improve heat transfer and maintain the sparking gap. As is known in the related arts, the terminal stud can comprise steel or a steel-based alloy material with a nickel-plated finish.

As illustrated, the insulator has an elongated, substantially cylindrical body with a first 30, a second 32, and a third 34 insulator sections each having different diameters. The first insulator section substantially surrounds the center electrode and terminates at a distal end 36 that has a tapered or flared configuration 38. The second insulator section is located intermediate first and third insulator sections and the diameter of the second insulator section is greater than that of either of the other two insulator sections. The second insulator section and the narrower first insulator section are separated from each other by a shoulder portion 40.

The spark plug further comprises an outer shell 16 and a ground shield 44. The outer shell further comprises a jamb nut portion 46 at one end and a motor seat portion 48 at an opposite end. Located between the jamb nut portion and the motor seat portion is a plurality of threads 50 that are configured to threadingly engage a threaded portion of a generally cylindrical opening that is in communication with the combustion chamber of an internal combustion engine. The threaded portion of the outer shell is configured to surround the second section of the insulator. The jam nut portion is integrally formed with the outer shell such that the spark plug can be removed in a helical pattern as the jam nut is unscrewed, resulting in easy, direct removal with negligible tipping. A suitable socket tool can engage the jam nut of the outer shell for screwing the spark plug into and out of the engine bore.

The motor seat portion of the outer shell includes a flared portion that is situated below the threaded section of the outer shell and overlaps a complimentary flared section 52 of the ground shield in juxtaposed alignment with shoulder portion 40 of the insulator when the spark plug assembly is complete. At this juncture, the ground shield and the outer shield are secured together, with the insulator being captured therewithin.

Figure 4:
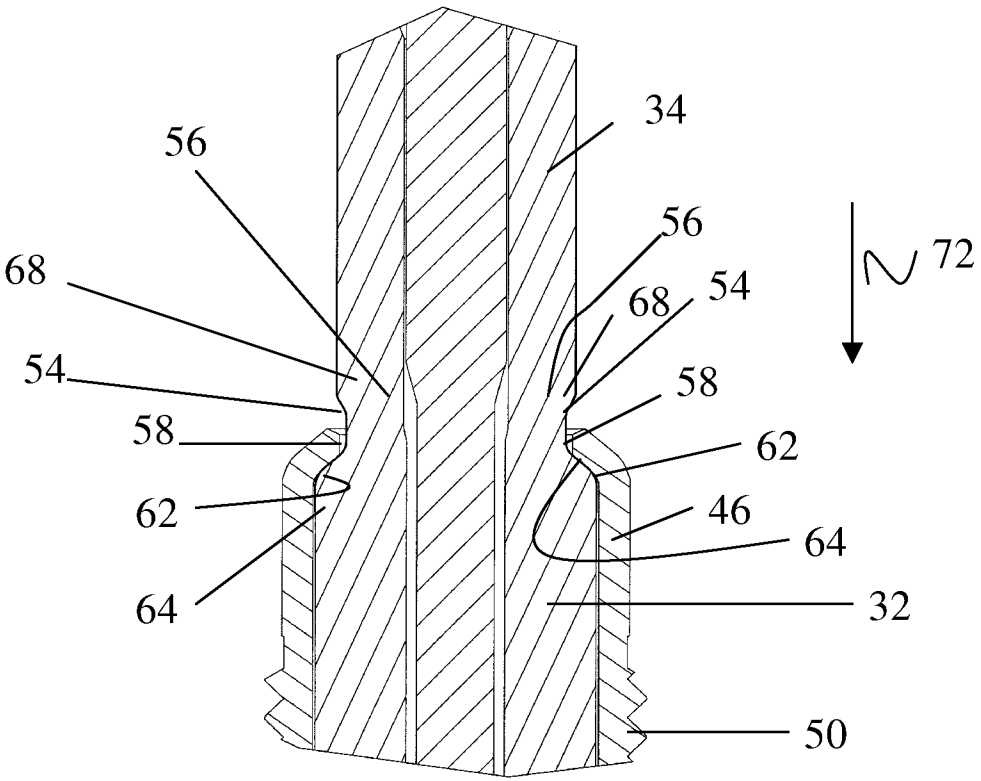
FIG. 4 is an enlarged view of a portion of FIG. 2.

Referring now in particular to FIGS. 2 and 4, the insulator further comprises a channel, groove or undercut 54 formed in the exterior surface of the insulator, the channel provides a section 56 of the insulator located between the second portion and the third portion of the insulator. Section 56 has a reduced thickness such that is smaller than adjacent portions of the second section and the third section. In addition, the channel is located such that it is aligned with a distal end 58 extending from the jamb nut portion.

The distal end 58 further comprises an inner shoulder portion 62 that is configured to engage a complimentary shoulder portion 64 of the insulator. As illustrated, shoulder portion 64 is located between channel portion 54 and second portion 32 of the insulator.

At the opposite end of the channel, the thickness of the insulator wall increases at a point 68 and the third insulator section protrudes from the distal end of the outer shell. As such and when the hex of the jamb nut is 14 mm, the insulator size of the third insulator section and the corresponding terminal stud can be the same size as those used with spark plugs having a jamb nut with a 16 mm dimension. For example, a 14 mm hex dimension spark plug would typically have a barrel dimension or third section dimension of 9 mm and a 16 mm hex dimension spark plug would have a barrel dimension or third section dimension of 10.5 mm. Furthermore, the resulting terminal stud size would vary according to the barrel dimension. Therefore and by providing the crimp or channel 54 in the spark plug insulator 10.5 mm barrel dimension insulator and corresponding terminal stud can be used with a spark plug having a hex nut size of 14 mm. Of course, the aforementioned ranges and dimensions are merely provided as examples and exemplary embodiments of the present invention are not intended to be limited to the specific ranges and dimensions disclosed herein.

During assembly, the insulator is inserted axially into the outer shell in the direction of arrow 72 then the motor seat portion 48 is pressed over flared portion 52 of the ground shield and the distal end 58 is crimped into the channel or undercut 56 such that the insulator is captured within the assembly of the outer shell and the ground shield via shoulders 64 and 40 of the insulator as well as the distal end 58 and motor seat portion of the outer shell.

The assembled outer shell and ground shield thus function as a unit. In alternative configurations, the motor seat portion of the outer shell and portion 52 of the ground shield can also be joined to one another using a joining technique such as brazing, laser welding, resistance welding, or plasma welding, to secure the ground shield and the retainer together. In exemplary embodiments of the present invention, the motor seat portion of the outer shell can be "hot pressed" onto the flared portion of the ground shield. In addition, the ground shield may also comprise a ground strap with a ground electrode that extends over the center electrode tip. Moreover, the spark plug may also have various other configurations. Non-limiting examples of spark plug and ground shield/strap configurations are found in the following U.S. Pat. Nos. 5,091,672; 5,697,334; 5,918,571; and 6,104,130 and U.S. Patent Publications US 2008/0272683; US 2009/0079319; US 2009/0121603; US 2009/0189503; US 2009/0189505; and US 2009/0189506 the contents each of which are incorporated herein by reference thereto.

The outer shell will comprise a conductive metal material such as a nickel-plated, carbon steel-based alloy and the threaded section can have an outer thread diameter of about 12-16 mm or less; and the non-threaded section can have an outer diameter of about 6-10 mm to provide a small diameter spark plug thereby allowing for a greater amount of engine space as described above.

The shape, size, and particular construction of outer shell as well as the insulator may, of course, vary greatly from one design to another; hence, the aforementioned dimensional attributes of the outer shell and spark plug are merely provided as non-limiting examples and exemplary embodiments of the present invention contemplate sizes greater or less than these values.

Still further, noble metal chips can be joined to the center electrode tip and a ground electrode strap by any suitable joining technique such as brazing, laser welding, resistance welding, or plasma welding.

The insulator is formed from a non-conducting ceramic material such as, for example, alumina ceramic so that it may fixedly retain center electrode while preventing an electrical short between the center electrode and the ground shield. Of course, any other suitable equivalent materials may be used.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims and their legal equivalence.

What is claimed is:

1. A method of forming a spark plug including an insulator having a first section at a first end of the insulator, a second section, and a third section at a second end of the insulator opposite the first end of the insulator, wherein the second section is disposed between the first and third sections, the insulator further including a channel formed between the second and third sections and a first shoulder formed between the first and second sections, a two-piece outer shell disposed about the insulator, and a center electrode disposed within a passage in the insulator, the method comprising the steps of:

inserting the insulator into the two-piece outer shell such that:

a first end of a first piece of the outer shell is adjacent the first end of the insulator and a second end of the first piece is disposed adjacent the first shoulder of the insulator;

a second piece of the outer shell is configured to include a first end, an opposite second end, a threaded portion located between the first end and the second end, and a jamb nut portion located between the threaded portion and the second end; and the first end of the second piece of the outer shell is adjacent the second end of the first piece of the outer shell, and the second end of the second piece of the outer shell is disposed adjacent a second shoulder of the insulator and the channel of the insulator;

overlapping the first end of the second piece of the outer shell to the second end of the first piece of the outer shell at the first shoulder; and crimping the second end of the second piece of the outer shell around the second shoulder to extend into the channel of the insulator.

2. The method of claim 1, wherein the first end of the second piece of the outer shell and the second end of the first piece of the outer shell are flared to facilitate overlapping.

3. A spark plug for an internal combustion engine, the spark plug comprising:

an elongated center electrode having a center electrode tip at a first end and a terminal proximate a second, opposite end;

an insulator substantially surrounding the center electrode;

a two-piece shell substantially surrounding the insulator, the two-piece shell including:

an outer shell surrounding a portion of the insulator, the outer shell having a jamb nut portion and a motor seat portion opposite the jamb nut portion, the motor seat portion corresponding with the first end of the center electrode; and a ground shield surrounding a portion of the insulator and secured between the motor seat portion of the outer shell and the insulator, the ground shield including an outwardly flared section and a straight section, the outwardly flared section extending a first distance;

wherein the motor seat portion completely surrounds the outwardly flared section of the ground shield when the ground shield is secured between the motor seat portion and the insulator; and wherein the motor seat portion surrounds a portion of the straight section of the ground shield when the ground shield is secured between the motor seat portion and the insulator, the motor seat portion surrounding the straight section for a second distance, wherein the second distance is greater than the first distance.

4. The method as in claim 1, wherein the threaded portion is located on an exterior surface of the outer shell between the first end and second end of the outer shell about a portion of the insulator having a diameter greater than a remainder of the insulator.

5. The method as in claim 1, wherein the second section has a larger thickness than the first section and the third section.

6. The method as in claim 5, the second shoulder being configured to engage the second end of the outer shell.

7. The method as in claim 6, wherein the insulator is made from a non-conducting ceramic material and wherein the second end of the second piece of the outer shell has a dimension of approximately 14 mm and the third section of the insulator has a diameter of approximately 10 mm.

8. The method as in claim 6, wherein the center electrode extends from one end of the insulator and the terminal extends from an opposite end of the insulator.

* * * * *